US006820820B1

(12) United States Patent
Boecking

(10) Patent No.: US 6,820,820 B1
(45) Date of Patent: Nov. 23, 2004

(54) HYDRAULIC CONTROL DEVICE, IN PARTICULAR FOR AN INJECTOR

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 82 days.

(21) Appl. No.: 10/111,289

(22) PCT Filed: Oct. 12, 2000

(86) PCT No.: PCT/DE00/03590

§ 371 (c)(1),
(2), (4) Date: Aug. 8, 2002

(87) PCT Pub. No.: WO01/29395

PCT Pub. Date: Apr. 26, 2001

(30) Foreign Application Priority Data

Oct. 22, 1999 (DE) ..... 199 51 004

(51) Int. Cl.[7] ..... B05B 1/08; B05B 1/30; F02M 47/02

(52) U.S. Cl. ..... 239/102.2; 239/533.3; 239/533.8; 239/533.9; 239/585.5

(58) Field of Search ..... 239/102.2, 102.1, 239/88–93, 533.2, 533.3, 533.8, 533.9, 585.1, 585.2, 585.3, 585.4, 585.5, 124; 251/129.15, 129.21

(56) References Cited

U.S. PATENT DOCUMENTS 5,779,149 A * 7/1998 Hayes, Jr. ..... 239/124
5,884,848 A * 3/1999 Crofts et al. ..... 239/533.2
5,979,803 A * 11/1999 Peters et al. ..... 239/533.4
6,079,641 A * 6/2000 Shinogle et al. ..... 239/533.4

FOREIGN PATENT DOCUMENTS

DE 195 19 192 C 6/1996
DE 198 03 910 A 11/1998

* cited by examiner

*Primary Examiner*—Davis Hwu
(74) *Attorney, Agent, or Firm*—Ronald E. Greigg

(57) ABSTRACT

The invention is based on a hydraulic control device (60), in particular for an injector (16) of a fuel injection system (10) in motor vehicles. Known control devices have a piezoelectric actuator, which controls a multi-position valve (75), embodied as an outward-opening valve with a valve member (74) guided in a valve bore (76).

According to the invention, it is proposed that a booster (62) that reverses the deflection motion of the actuator (52) be disposed between the actuator (52) and the valve member (74), and that the multi-position valve (75) be embodied as an inward-opening 3/2-way valve. The valve member (74) of this valve, in operative connection with a valve seat (98) and a control edge (96), alternatingly opens or closes pressure fluid connections between pressure fluid conduits (86, 88, 92).

19 Claims, 2 Drawing Sheets

HYDRAULIC CONTROL DEVICE, IN PARTICULAR FOR AN INJECTOR

CROSS-REFERENCE TO RELATED APPLICATIONS

This application is a 35 U.S.C. 371 application of PCT/DE 00/03590, filed on Oct. 12, 2000.

BACKGROUND OF THE INVENTION

1. Field of the Invention

The invention is based on a hydraulic control device for an injector of a fuel injection system in motor vehicles.

2. Description of the Prior Art

One hydraulic control device known from German Patent Disclosure DE 196 24 001 A1 comprises a piezoelectric actuator and a multi-position valve, controlled by the actuator, with a valve member guided displaceably in a valve bore. The multiposition valve is embodied as a conventional seat valve and controls a pressure fluid connection between a pressure fluid conduit, which carries fuel under high pressure, and a return line. In the non-triggered state of the actuator, the valve member is lifted from the valve seat and thus opens the aforementioned pressure fluid connection. As a result, the pressure level in an injection nozzle, also coupled to the pressure fluid conduit that carries high pressure, drops. Once the pressure drops below a mechanically specified opening pressure, a pressure-controlled closing element of the injection nozzle uncovers injection openings. Through these injection openings, fuel reaches a combustion chamber of an internal combustion engine. With the closure of the valve seat by an electrical triggering of the actuator, the injection event is terminated.

The pressure drop at the valve seat is in the same direction as the stroke motion of the valve member, so that the multi-position valve forms an outward opening or so-called A-valve. Outward-opening valves have fluid disadvantages, since the closing motion takes place counter to high pressure, and hence the actuator must be embodied as suitably powerful and voluminous. Furthermore, outward-opening valves are more expensive to produce.

SUMMARY OF THE INVENTION

The hydraulic control device of the invention has the advantage of being embodied as an inward-opening I-valve. In inward-opening valves, the pressure drop at the valve seat is oriented counter to the direction of motion of the valve member. As a result, upon opening of the multi-position valve, the stroke motion of the valve member is reinforced by an additional hydraulic force, so that actuators with lesser actuating forces suffice to control the valve. Such actuators are correspondingly smaller in size and more compact and require less electrical power. The load on the actuators thus drops, so that they function more robustly and reliably.

BRIEF DESCRIPTION OF THE DRAWINGS

One exemplary embodiment of the invention is described in detail herein below, with reference to the drawings, in which.

DESCRIPTION OF THE PREFERRED EMBODIMENT

Figure 1:
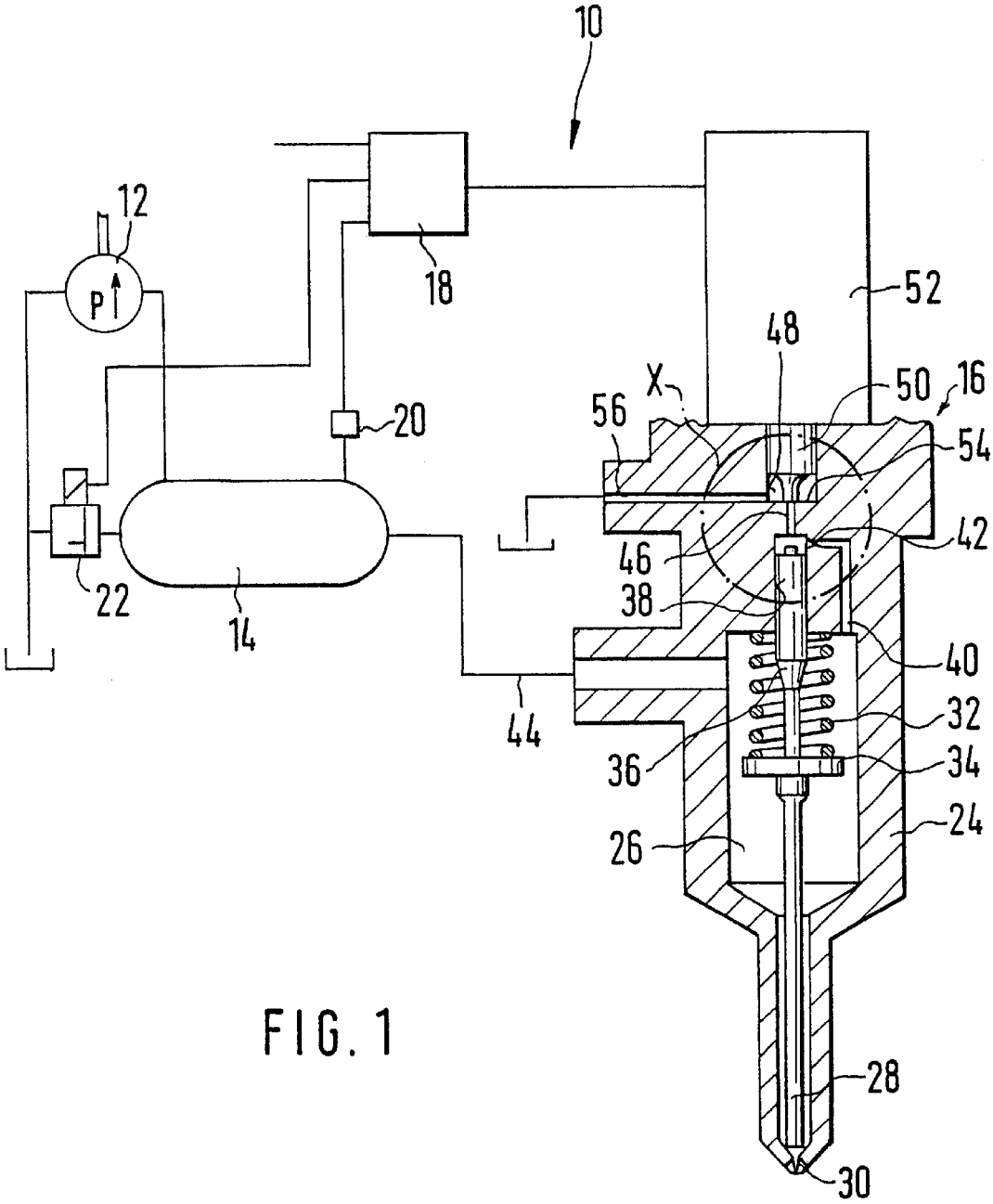
FIG. 1 shows a fuel injection system with an outward-opening valve of the kind already known from the prior art.

FIG. 1, in a schematically simplified illustration, shows a fuel injection system 10. This system comprises a driven pressure generator 12 and a pressure reservoir 14 coupled to it. The latter communicates with an injector 16. An electronic control unit 18 is also present, which with the aid of a pressure sensor 20 and a pressure regulating valve 22 keeps the pressure in the pressure reservoir 14 constant. A plurality of injectors 16 can be connected to the pressure reservoir 14, but in FIG. 1 for the sake of example only one of these injectors 16 is shown.

This injector 16 has a housing 24, in whose interior 26 a needle 28 is disposed. With its tip, this needle controls injection openings 30, which discharges into the combustion chamber of an internal combustion engine, not shown. The needle 28 is acted upon mechanically by a closing spring 32, which is braced on the wall of the interior 26 and on a plate 34 embodied on the inner end of the needle 28. Also acting on the plate 34 is a tappet 36, disposed coaxially to the closing spring 32. This tappet is guided in a cylindrical bore 38 of the housing 24. The cylindrical bore 38 communicates hydraulically, via a tie line 40, with a throttle 42 disposed in it, with the interior 26, so that the tappet 36 can be relieved hydraulically.

A pressure fluid conduit 44 arriving from the pressure reservoir 14 supplies the interior 26 and the cylindrical bore 38 with fuel which is at high pressure. The pressure of this fuel, via the tappet 36, puts a load on the needle 28. Together with the force of the closing spring, the resultant force on the needle 28 suffices to keep it in the closing position, shown.

In addition, a tie line 46 discharging into a valve bore 48 branches off from the cylindrical bore 38. A valve member 50 acted upon by a piezoelectric actuator 52 is guided in the valve bore 48. The valve member, in the triggered state of the actuator 52, closes a valve seat 54, embodied at the point of discharge of the tie line 46 into the valve bore 48, and thus interrupts a pressure fluid communication with a return line 56, which likewise branches off from the valve bore 48. Thus high pressure prevails in the interior 26 of the injector 16.

With the withdrawal of the electrical triggering of the actuator 52, the valve member 50 lifts from the valve seat 54 and opens the aforementioned pressure fluid connection. The high pressure in the injector thereupon builds up, and the hydraulic pressure force acting on the tappet 36 is eliminated. The mechanical pressure force exerted by the closing spring 32 does not by itself suffice to keep the needle 28 in its closing position. The needle 28 therefore opens and uncovers the injection openings 30.

Upon re-triggering of the actuator 52, the valve seat 54 is closed again by the valve member 50, as a result of which high pressure builds up again in the interior 26 of the injector 16. The accordingly hydraulically loaded needle 28 closes the injection openings 30 again and terminates the injection event.

When the valve seat 54 is open, the pressure drop is accordingly in the same direction as the stroke motion of the valve member 50. Hence this valve member 50 forms an outward-opening valve. An injection event is initiated by withdrawal of the triggering of the actuator 52 and is terminated by the triggering of the actuator. The actuator 52 must close the valve member 50 counter to high pressure and must be embodied correspondingly powerfully. Along with the load on the actuator 52, its structural volume is thus also increased.

Figure 2:
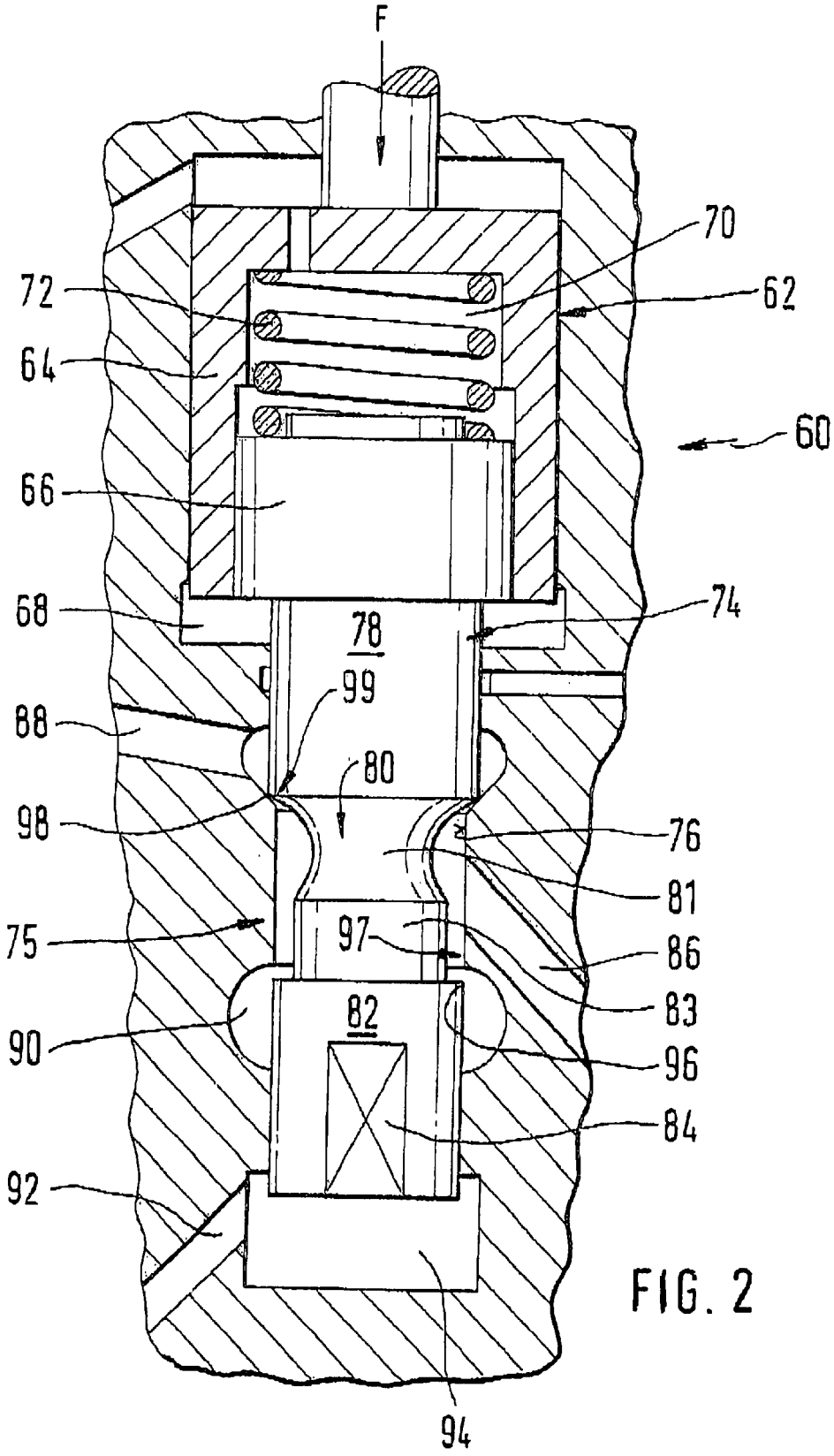
FIG. 2 shows the detail X of FIG. 1, on an enlarged scale, with an I-valve opening inward according to the invention, upstream of which is a hydraulic booster, and in which a force reversal takes place in the booster.

To avoid these disadvantages, in FIG. 2 a control device 60 is proposed which is embodied as an inward-opening valve. This control device 60, in which the actuator is represented only symbolically by a force arrow F, has a hydraulic booster 62. This hydraulic booster comprises a cup-shaped first piston 64 and a second piston 66, guided in its interior, of lesser pressure area. With their end faces, the pistons 64, 66 define a pressure-fluid-filled booster chamber 68, which is located outside a hollow chamber 70 that is enclosed by the two pistons 64 and 66 and is ventilated to the outside. A closing spring 72 is accommodated in this hollow chamber 70 and is braced on the two pistons 64 and 66.

The piston 66 is either connected to the valve member 74 of a multi-position valve 75 or embodied in one piece with such a valve member; the valve member 74 is guided displaceably in a valve bore 76. This valve member 74 has a control head 78, toward the booster 62, which with increasing distance from the piston 66 changes over into a constriction 80 and then into a guide portion 82. The guide portion 82 is provided with a flat face 84 on its outer circumference. The constriction 80 comprises a waist 81, toward the control head 78, and a cylindrical bore 83, located adjacent the guide portion 82, that has a smaller outer diameter than the valve bore 76.

A pressure fluid conduit 86, leading to an injection nozzle, not shown, branches off from the valve bore 76 in the region of the constriction 80, while a fuel supply conduit 88 discharges into the valve bore 76 in the region of the control head 78. An annular conduit 90 is also provided, in the form of a groovelike enlargement of the valve bore 76 in the region of the guide portion 82. This conduit is connectable via the flat face 84 to a return line 92, which branches off from a pressure chamber 94 embodied at the end of the valve bore 76.

A control edge 96 of the valve member 74, embodied at the transition from the constriction 80 to the guide portion 82, controls a first control cross section 97 located between the pressure fluid conduit 86 and the return line 92. This first control cross section 97 is open in its basic position, as shown in FIG. 2. The injection nozzle, not visible in FIG. 2, is thus pressure-relieved.

The valve bore 76 is reduced in its outer diameter at the transition from the control head 78 to the constriction 80. The resultant change in diameter is embodied as a chamfer, which functions as a valve seat 98. This valve seat forms a second control cross section 99, which is controllable by the control head 78 of the valve member 74 and which is closed in the basic position shown.

With the withdrawal of the triggering of the actuator 52, the valve member 74 coupled to the piston 66 is imparted a stroke motion that is oriented counter to the deflection motion of the actuator 52. The valve member 74 accordingly opens the first control cross section 99 and simultaneously, with its control edge 96, closes the first control cross section 97. The resultant pressure fluid connection between the fuel supply conduit 88 and the pressure fluid conduit 86 causes the injection nozzle to come under high pressure and assume its closing position. Accordingly, in the manner typical of an inward-opening valve, the flow of pressure fluid at the opened valve seat 98 is oriented counter to the stroke motion of the valve member 74.

In the multi-position valve 75 described, the hydraulically operative faces of the valve seat 98 and of the guide portion 82 are designed as being equal in size. Thus in the basic position shown, a pressure equilibrium prevails at t he valve member 74. Accordingly, the actuator must overcome only the contrary force of the closing spring 72 in order to put the valve member 74 in its closing position, and the actuator can accordingly be designed in compact form. If the valve member 74 is in the switching position, the hydraulic forces acting on the valve member 74 are essentially balanced by the contrary force of the closing spring 72. Unlike an outward-opening valve (FIG. 1), an injection event takes place by triggering of the actuator 52, and is terminated again by withdrawal of this triggering.

It is understood that changes or additions to the exemplary embodiment described are possible with out departing from the fundamental concept of the invention.

I claim:

1. In a hydraulic control device (60), for an injector (16) of a fuel injection system (10), which system includes an externally actuatable pressure generator (12), a pressure reservoir (14) hydraulically coupled to the pressure generator (12), and a plurality of injectors (16), connected to the pressure reservoir (14) and each assigned to one combustion chamber of an internal combustion engine, having a piezoelectric actuator (52) and a multi-position valve (75), controlled by the actuator (52), in whose valve bore (76) a valve member (74) is guided displaceably, by which, via one control cross section (99) controlled by a seat valve part of the valve member (74), the injection valve member (28) of the injector is urged in the closing direction by control pressure, and by which, via another control cross section (97) controlled by the valve member (74), the injection valve member can be relieved to a return line, and the control cross sections (97, 99) are opened or closed in alternation by the valve member, the improvement comprising a hydraulic booster (62) that reverses the deflection motion of the actuator (52) to the opposite direction in space is connected between the actuator (52) and the valve member (73);

a control edge (96) on the valve member (74), for controlling the other control cross section (97), and the pressure drop at the opened, first control cross section (99) being oriented counter to the stroke motion of the valve member (74).

2. The hydraulic control device of claim 1, wherein the booster (62) has pistons (64, 66) with piston surface areas of difference size; that the first piston (64) is embodied as a cup-shaped and in its interior guides the second piston (66); that a closing spring (72) is fastened between the two pistons (64 and 66); and that the pistons (64, 66) define a common booster chamber (68).

3. The hydraulic control device of claim 2, wherein the valve member (74) is anchored to the second piston (66).

4. The hydraulic control device of claim 1, wherein the valve member (74) has a control head (78) which is thickened in its outer diameter, a constriction (80), and a guide portion (82); that the outer diameter of the guide portion (82) is greater than that of the constriction (80) but less than that of the control head (78); and that the guide portion (82) is provided with at least one flat face (84) provided on the outer circumference.

5. The hydraulic control device of claim 2, wherein the valve member (74) has a control head (78) which is thickened in its outer diameter, a constriction (80), and a guide portion (82); that the outer diameter of the guide portion (82) is greater than that of the constriction (80) but less than that of the control head (78); and that the guide portion (82) is provided with at least one flat face (84) provided on the outer circumference.

6. The hydraulic control device of claims 3, wherein the valve member (74) has a control head (78) which is thickened in its outer diameter, a constriction (80), and a guide portion (82); that the outer diameter of the guide portion (82) is greater than that of the constriction (80) but less than that of the control head (78); and that the guide portion (82) is provided with at least one flat face (84) provided on the outer circumference.

7. The hydraulic control device of claim 4, wherein the valve seat (98) is embodied at the transition point of the control head (78) to the constriction (80), on the suitably adapted inner wall of the valve bore (76), and is located between a fuel supply conduit (88) and a pressure fluid conduit (86) to the injector (16).

8. The hydraulic control device of claim 4, wherein the valve bore (76) is provided with a groovelike enlargement (90), which is controlled by the control edge (96) of the valve member (74) and which is embodied at the valve bore (76), in the region of the transition point of the constriction (80) to the guide portion (82) of the valve member (74).

9. The hydraulic control device of claim 7, wherein the valve bore (76) is provided with a groovelike enlargement (90), which is controlled by the control edge (96) of the valve member (74) and which is embodied at the valve bore (76), in the region of the transition point of the constriction (80) to the guide portion (82) of the valve member (74).

10. The hydraulic control device of claim 4, further comprising a fuel supply conduit (88) discharging into the valve bore (76) in the region of the control head (78), and a pressure fluid conduit (86) to the injector (16) branches off from the valve bore (76) in the region of the constriction (80), and a return (92) branches off from the valve bore in the region of the guide portion (82) of the valve member (74).

11. The hydraulic control device of claim 7, further comprising a fuel supply conduit (88) discharging into the valve bore (76) in the region of the control head (78), and a pressure fluid conduit (86) to the injector (16) branches off from the valve bore (76) in the region of the constriction (80), and a return (92) branches off from the valve bore in the region of the guide portion (82) of the valve member (74).

12. The hydraulic control device of claim 8, further comprising a fuel supply conduit (88) discharging into the valve bore (76) in the region of the control head (78), and a pressure fluid conduit (86) to the injector (16) branches off from the valve bore (76) in the region of the constriction (80), and a return (92) branches off from the valve bore in the region of the guide portion (82) of the valve member (74).

13. The hydraulic control device of claim 4, wherein the control head (78) is located toward the second piston (66), and the guide portion (82) is located remote from the second piston (66), and that the constriction (80) is disposed between the control head (78) and the guide portion (82).

14. The hydraulic control device of claim 7, wherein the control head (78) is located toward the second piston (66), and the guide portion (82) is located remote from the second piston (66), and that the constriction (80) is disposed between the control head (78) and the guide portion (82).

15. The hydraulic control device of claim 10, wherein the control head (78) is located toward the second piston (66), and the guide portion (82) is located remote from the second piston (66), and that the constriction (80) is disposed between the control head (78) and the guide portion (82).

16. The hydraulic control device of claim 4, wherein the constriction (80) is composed of a waist (81) oriented toward the control head (78) and a cylindrical portion (83), oriented toward the guide portion (82), the outer diameter of the cylindrical portion being less than the inner diameter of the valve bore (76).

17. The hydraulic control device of claim 10, wherein the constriction (80) is composed of a waist (81) oriented toward the control head (78) and a cylindrical portion (83), oriented toward the guide portion (82), the outer diameter of the cylindrical portion being less than the inner diameter of the valve bore (76).

18. The hydraulic control device of claim 1, wherein the valve bore (76) is embodied as a blind bore, which ends in a control chamber (94) into which the valve member (74) plunges and from which a return (92) branches off.

19. The hydraulic control device of claim 7, wherein the valve bore (76) is embodied as a blind bore, which ends in a control chamber (94) into which the valve member (74) plunges and from which a return (92) branches off.

* * * * *